US006820293B2

(12) United States Patent
Alverson

(10) Patent No.: US 6,820,293 B2
(45) Date of Patent: Nov. 23, 2004

(54) BED SIDERAIL PAD APPARATUS

(75) Inventor: Curtis Alverson, Shelbyville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/255,196

(22) Filed: Sep. 26, 2002

(65) Prior Publication Data

US 2004/0060111 A1 Apr. 1, 2004

(51) Int. Cl.[7] ..... A47C 21/08
(52) U.S. Cl. ..... 5/425; 5/663
(58) Field of Search ..... 5/424, 425, 427, 5/663

(56) References Cited

U.S. PATENT DOCUMENTS

| | | | | |
|---|---|---|---|---|
| 421,656 | A | 2/1890 | Blanken | 5/425 |
| 993,119 | A | 5/1911 | Stannard | 5/512 |
| 1,398,203 | A | 11/1921 | Schmidt | 5/618 |
| 2,136,088 | A | 11/1938 | Stevens | 5/429 |
| 2,164,484 | A | 7/1939 | Wolfe | 5/425 |
| 2,281,209 | A | 4/1942 | Smith | 5/618 |
| 2,452,366 | A | 10/1948 | Freund | 5/624 |
| 2,556,591 | A | 6/1951 | Loxley | 5/618 |
| 2,564,083 | A | 8/1951 | Stechert | 5/618 |
| 2,587,291 | A | 2/1952 | Rochers | 5/430 |
| 2,605,151 | A | 7/1952 | Shampaine | 5/602 |
| 2,644,173 | A | 7/1953 | James | 5/425 |
| 2,710,976 | A | 6/1955 | Martensen | 5/98.1 |
| 2,722,017 | A | 11/1955 | Burst et al. | 5/428 |
| 2,766,463 | A | 10/1956 | Bendersky | 5/623 |
| 2,817,854 | A | 12/1957 | Pratt | 5/428 |
| 2,817,855 | A | 12/1957 | Pratt | 5/430 |
| 2,869,614 | A | 1/1959 | Wamsley | 280/230 |
| 2,951,252 | A | 9/1960 | Roche | 5/279.1 |
| 3,010,121 | A | 11/1961 | Breach | 5/618 |
| 3,018,492 | A | 1/1962 | Rosen | 5/93.1 |
| 3,021,534 | A | 2/1962 | Hausted | 5/430 |
| 3,053,568 | A | 9/1962 | Miller | 297/78 |
| 3,055,020 | A | 9/1962 | Mann | 5/430 |
| 3,099,440 | A | 7/1963 | Burzlaff | 5/614 |
| 3,112,500 | A | 12/1963 | MacDonald | 5/618 |
| 3,138,805 | A | 6/1964 | Piazza | 5/618 |
| 3,148,387 | A | 9/1964 | Samie et al. | 5/632 |
| 3,210,779 | A | 10/1965 | Herbold | 5/610 |
| 3,220,021 | A | 11/1965 | Nelson | 5/618 |
| 3,220,022 | A | 11/1965 | Nelson | 5/618 |
| 3,233,255 | A | 2/1966 | Propst | 5/610 |
| 3,239,853 | A | 3/1966 | MacDonald | 5/616 |
| 3,249,387 | A | 5/1966 | Pivacek | 297/411.33 |
| 3,309,717 | A | 3/1967 | Black | 5/618 |
| 3,321,779 | A | 5/1967 | Kaufman et al. | 5/93.1 |
| 3,344,445 | A | 10/1967 | Crawford | 5/430 |
| 3,351,962 | A | 11/1967 | Dodrill et al. | 5/429 |
| 3,406,772 | A | 10/1968 | Ahrent et al. | 180/9.23 |
| 3,456,269 | A | 7/1969 | Goodman | 5/618 |
| 3,486,176 | A | 12/1969 | Murcott | 5/428 |
| 3,585,659 | A | 6/1971 | Burst et al. | 5/430 |
| 3,593,350 | A | 7/1971 | Knight et al. | 5/616 |
| 3,619,824 | A | 11/1971 | Doyle | 5/143 |

(List continued on next page.)

FOREIGN PATENT DOCUMENTS

| | | |
|---|---|---|
| DE | 199 00 602 C 1 | 7/2000 |
| EP | 0 037 063 A2 | 10/1981 |
| FR | 1450817 | 8/1966 |
| GB | 1466080 | 3/1977 |
| GB | 2 313 303 A | 11/1997 |
| WO | WO 98/17153 | 4/1998 |
| WO | WO 99/15126 | 4/1999 |

OTHER PUBLICATIONS

Paramount Bed Product Brochure, date unknown.
Hill–Rom Med Surg Bed Accessories, 1997.

*Primary Examiner*—Robert G. Santos
(74) *Attorney, Agent, or Firm*—Bose McKinney & Evans LLP

(57) ABSTRACT

A barrier is provided for use on a patient support. The barrier can be coupled to a siderail of the patient support to substantially fill a gap adjacent to the siderail.

24 Claims, 6 Drawing Sheets

U.S. PATENT DOCUMENTS 3,640,566 A 2/1972 Hodge ..... 297/68
3,742,530 A 7/1973 Clark ..... 5/482
3,851,345 A 12/1974 Benoit et al. ..... 5/429
3,865,434 A 2/1975 Sully ..... 297/411.33
3,877,090 A 4/1975 Schutz ..... 5/93.1
3,893,197 A 7/1975 Ricke ..... 5/651
3,897,973 A 8/1975 Long et al. ..... 297/75
3,905,591 A 9/1975 Schorr et al. ..... 5/601
3,916,461 A 11/1975 Kerstholt ..... 5/618
3,971,083 A 7/1976 Peterson ..... 5/430
4,127,906 A 12/1978 Zur ..... 5/615
4,139,917 A 2/1979 Fenwick ..... 5/602
4,168,099 A 9/1979 Jacobs et al. ..... 297/325
4,183,015 A 1/1980 Drew et al. ..... 340/825.19
4,186,456 A 2/1980 Huempfner ..... 5/428
4,214,326 A 7/1980 Spann ..... 5/632
4,215,446 A 8/1980 Mahoney ..... 5/425
4,232,415 A 11/1980 Webber ..... 5/427
4,240,169 A 12/1980 Roos ..... 5/613
4,258,445 A 3/1981 Zur ..... 5/614
4,312,500 A 1/1982 Janssen ..... 5/618
4,336,621 A 6/1982 Schwartz et al. ..... 5/658
4,370,765 A 2/1983 Webber ..... 5/427
4,409,695 A 10/1983 Johnston et al. ..... 5/601
4,439,880 A 4/1984 Koncelik et al. ..... 5/429
4,453,732 A 6/1984 Assanah et al. ..... 280/648
D276,112 S 10/1984 Ferrell et al. ..... D6/503
4,557,471 A 12/1985 Pazzini ..... 5/618
4,607,402 A 8/1986 Pollard ..... 5/425
4,612,679 A 9/1986 Mitchell ..... 5/425
4,653,129 A 3/1987 Kuck et al. ..... 5/430
4,654,903 A 4/1987 Chubb et al. ..... 5/607
4,670,923 A 6/1987 Gabriel et al. ..... 5/424
4,672,698 A 6/1987 Sands ..... 5/424
4,675,926 A 6/1987 Limdblom et al. ..... 5/618
4,676,687 A 6/1987 Koffler ..... 403/386
4,685,159 A 8/1987 Oetiker ..... 5/608
4,704,750 A 11/1987 Wheelock ..... 5/127
4,710,049 A 12/1987 Chang ..... 403/23
4,710,992 A 12/1987 Falwell ..... 5/663
4,745,647 A 5/1988 Goodwin ..... 5/713
4,747,171 A 5/1988 Einsele et al. ..... 5/425
4,751,754 A 6/1988 Bailey et al. ..... 5/611
4,767,419 A 8/1988 Fattore ..... 5/659
4,768,249 A 9/1988 Goodwin ..... 5/713
4,783,864 A 11/1988 Turner ..... 5/424
4,800,600 A 1/1989 Baum ..... 5/93.1
4,827,545 A 5/1989 Arp ..... 5/424
4,839,933 A 6/1989 Plewright et al. ..... 5/86.1
4,847,929 A 7/1989 Pupovic ..... 5/608
4,858,260 A 8/1989 Failor et al. ..... 5/618
4,862,529 A 9/1989 Peck ..... 5/611
4,862,530 A 9/1989 Chen ..... 5/618
4,872,228 A 10/1989 Bishop ..... 5/425
4,873,734 A 10/1989 Pollard ..... 5/425
4,894,876 A 1/1990 Fenwick ..... 5/602
4,944,055 A 7/1990 Shainfeld ..... 5/618
4,974,905 A 12/1990 Davis ..... 297/377
4,985,946 A 1/1991 Foster et al. ..... 5/601
4,993,089 A 2/1991 Solomon et al. ..... 5/430
5,010,611 A 4/1991 Mallett ..... 5/497
5,035,014 A 7/1991 Blanchard ..... 5/424
5,040,253 A 8/1991 Cheng ..... 5/616
5,044,025 A 9/1991 Hunsinger et al. ..... 5/424
5,072,463 A 12/1991 Willis ..... 5/618
5,077,843 A 1/1992 Foster et al. ..... 5/600
5,083,332 A 1/1992 Foster et al. ..... 5/185
5,083,334 A 1/1992 Huck et al. ..... 5/430
5,084,925 A 2/1992 Cook ..... 5/425
5,097,550 A 3/1992 Marra ..... 5/424
5,129,117 A 7/1992 Celestina et al. ..... 5/602
5,175,897 A 1/1993 Marra ..... 5/425
5,179,744 A 1/1993 Foster et al. ..... 5/600
5,191,663 A 3/1993 Holder et al. ..... 5/424
5,193,633 A 3/1993 Ezenwa ..... 180/65.1
5,205,004 A 4/1993 Hayes et al. ..... 5/611
D336,577 S 6/1993 Celestina et al. ..... D6/503
5,216,768 A 6/1993 Bodine et al. ..... 5/711
5,230,113 A 7/1993 Foster et al. ..... 5/608
5,279,010 A 1/1994 Ferrand et al. ..... 5/600
5,381,571 A 1/1995 Gabhart ..... 5/430
5,384,927 A 1/1995 Mardero et al. ..... 5/662
5,410,765 A 5/1995 Youngblood ..... 5/93.1
5,418,988 A 5/1995 Iura ..... 5/430
5,421,046 A 6/1995 Vande Streek ..... 5/624
5,450,641 A 9/1995 Montgomery ..... 5/663
5,454,126 A 10/1995 Foster et al. ..... 5/618
5,455,973 A 10/1995 Brumfield et al. ..... 5/424
5,479,666 A 1/1996 Foster et al. ..... 5/624
5,481,772 A 1/1996 Glynn et al. ..... 5/663
5,485,699 A 1/1996 Gabhart ..... 49/394
5,524,306 A 6/1996 George ..... 5/424
5,537,701 A 7/1996 Elliott ..... 5/617
5,542,135 A 8/1996 Ozrovitz et al. ..... 5/424
5,557,817 A 9/1996 Haddock ..... 5/663
5,577,277 A 11/1996 Sundberg et al. ..... 5/426
5,577,279 A 11/1996 Foster et al. ..... 5/618
5,642,545 A 7/1997 Howard ..... 5/663
5,671,490 A 9/1997 Wu ..... 5/426
5,678,267 A 10/1997 Kinder ..... 5/662
5,689,839 A 11/1997 Laganiere et al. ..... 5/425
5,715,548 A 2/1998 Weismiller et al. ..... 5/624
5,732,423 A 3/1998 Weismiller et al. ..... 5/425
5,745,937 A 5/1998 Weismiller et al. ..... 5/624
5,749,112 A 5/1998 Metzler ..... 5/663
5,761,756 A 6/1998 Nowak et al. ..... 5/426
5,771,506 A 6/1998 Joiner ..... 4/575.1
5,781,945 A 7/1998 Scherer et al. ..... 5/426
5,802,636 A 9/1998 Corbin et al. ..... 5/425
5,832,549 A 11/1998 Le Pallec et al. ..... 5/430
5,864,900 A 2/1999 Landau ..... 5/427
5,878,452 A 3/1999 Brooke et al. ..... 5/428
5,926,873 A 7/1999 Fountain ..... 5/424
6,038,721 A 3/2000 Gordon ..... 5/663
6,058,531 A 5/2000 Carroll ..... 5/430
6,089,593 A 7/2000 Hanson et al. ..... 280/650
6,347,422 B2 * 2/2002 Heavrin ..... 5/663
6,401,277 B1 * 6/2002 Savage et al. ..... 5/430
6,427,264 B1 8/2002 Metz et al. ..... 5/425
6,615,426 B1 * 9/2003 Risk, Jr. ..... 5/425
6,629,326 B2 * 10/2003 Rabe ..... 5/663
6,668,399 B2 * 12/2003 Malstaff et al. ..... 5/424
6,704,954 B2 * 3/2004 Metz et al. ..... 5/425
2001/0044970 A1 * 11/2001 Heavrin ..... 5/663
2002/0170113 A1 * 11/2002 Metz et al. ..... 5/425
2004/0060111 A1 * 4/2004 Alverson ..... 5/425

* cited by examiner

BED SIDERAIL PAD APPARATUS

BACKGROUND AND SUMMARY OF THE INVENTION

The present invention generally relates to hospital beds having siderails and more particularly to barriers that are coupled to siderails.

Hospital beds often include siderails on either or both sides of the bed. Generally, the siderails may be lowered to allow a caregiver to easily attend to the patient. Hospital beds also often include headboards and/or footboards located at the ends of the bed. Gaps can be created between the headboard or footboard and the siderails.

According to a first aspect of the present invention, a patient support is provided. The patent support includes a frame, a mattress positioned on the frame, a board, and first and second barriers. The frame has first and second ends and longitudinal sides extending between the first and second ends. The board is coupled to one of the first and second ends of the frame. The first barrier is coupled to one of the sides of the frame and cooperates with the board to define a gap therebetween. The first barrier defines an opening therethrough. The second barrier is configured to substantially fill the gap and includes a barrier member and a coupler configured to rigidly couple the barrier member to the first barrier. The barrier member includes a surface sized to substantially cover a first side of the opening. The coupler includes a surface sized to substantially cover a second side of the opening in the first barrier and a fastener coupling the surface of the barrier member to the surface of the fastener.

According to another aspect of the present invention, a supplemental barrier for use with a patient support is provided. The patient support has a first barrier positioned to block egress of a patient from the patient support. The first barrier cooperates to define a gap adjacent thereto. The supplemental barrier includes a barrier member sized to substantially block the gap adjacent to the first barrier and a clamp configured to couple the barrier member to the first barrier.

According to another aspect of the present invention, a barrier is provided that is configured to couple to a patient support including a siderail defining an opening therethrough and an end board. The siderail and end board cooperate to define a gap. The barrier includes a barrier member sized to substantially fill the gap, a coupler including a fastener and a complementary member configured to complement the opening in the bed siderail. The fastener is configured to rigidly couple the barrier member to the siderail.

According to another aspect of the present invention, a barrier is provided that is configured to couple to a bed including a siderail and an end board. The siderail and end board cooperate to define a gap. The barrier includes a padded barrier member sized to substantially block the gap defined between the first and second barriers and a coupler configured to removably couple the barrier member to the first barrier.

According to another aspect of the present invention, a method for coupling a barrier to a siderail of a patient support is provided. The siderail includes an opening therethrough. The method includes the steps of providing a barrier including a coupler and a barrier member sized to substantially fill a gap adjacent to the siderail. The coupler includes a fastener and a complementary member. The complementary member is rigidly coupled to the barrier member and configured to complement the opening in the siderail. The fastener is configured to rigidly couple the barrier member to the siderail. The method further includes positioning the complementary member in the siderail opening and coupling the complementary member to the siderail with the fastener.

Additional features of the present invention will become apparent to those skilled in the art upon consideration of the following detailed description of the preferred embodiment exemplifying the best mode of carrying out the invention as presently perceived. Unless otherwise indicated, the components shown in the drawings of the embodiments are in proportion to one another.

BRIEF DESCRIPTION OF THE DRAWINGS

The detailed description particularly refers to the accompanying figures in which.

DETAILED DESCRIPTION OF EMBODIMENTS OF THE INVENTION

The embodiments described below and shown in the figures are merely exemplary and are not intended to limit the invention to the precise forms disclosed. Instead, the embodiments were selected for description to enable one of ordinary skill in the art to practice the invention.

Figure 1:
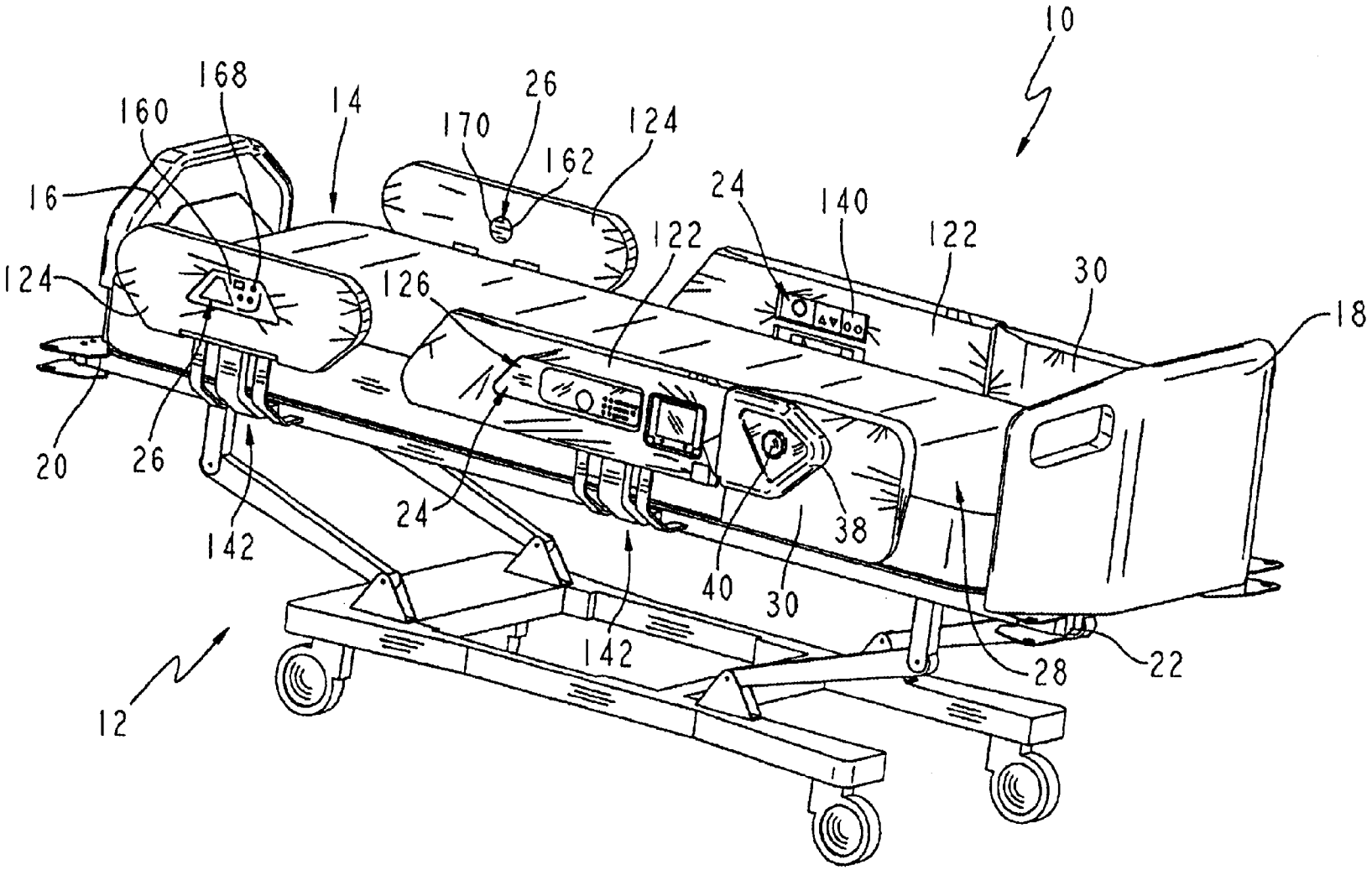
FIG. 1 is a perspective view of a patient support according to the present disclosure showing the patient support including a frame, a mattress positioned on the frame, a plurality of siderails positioned adjacent the mattress to block egress of a patient from the mattress, a pair of gap fillers coupled to two of the siderails, and a set of siderail covers positioned over the siderails.

As shown in FIG. 1, a patient support 10 may include a frame 12 and a mattress 14. It should be understood that patient support 10 may be a bed, a hospital bed, a stretcher, a gurney, or any other suitable device for supporting a patient. Patient support 10 also include a headboard 16 and a footboard 18. Headboard 16 is coupled to a first end 20 of frame 12. Footboard 18 is coupled to a second end 22 of frame 12.

Figure 2:
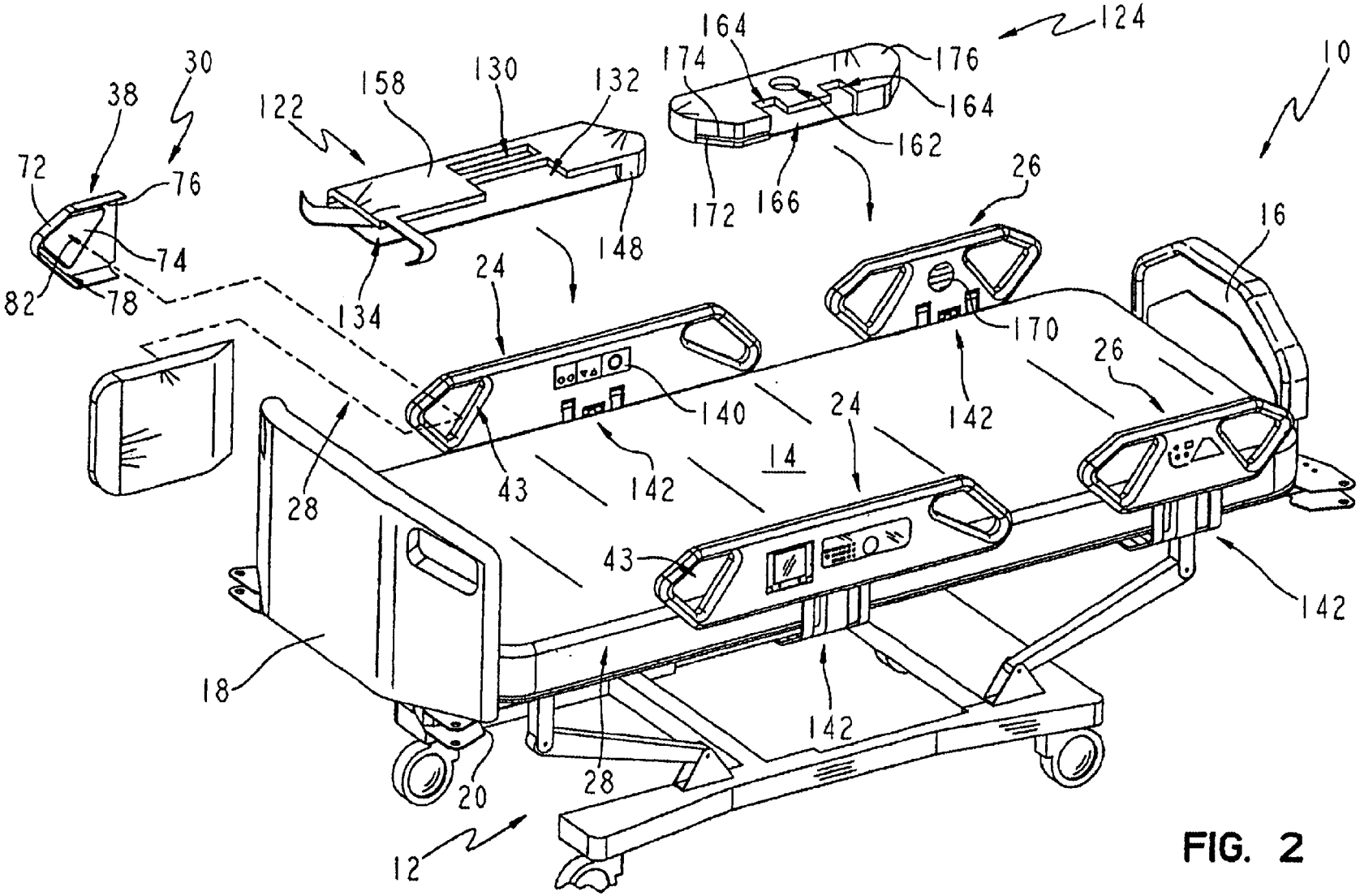
FIG. 2 is another perspective view of the patient support of FIG. 1 showing one of the gap fillers and two of the siderail covers before installation on the siderails.

Patient support 10 also include siderails 24, 26 coupled to opposite longitudinal sides 28, 30 of frame 12. Siderails 24, 26 are coupled to frame 12 to block egress of a patient from mattress 14. Siderails 24 and footboard 18 cooperate to define gaps 28 therebetween as shown in FIG. 2.

A pair of gap fillers 30 are provided that substantially fill and block egress of a patient through gaps 28. Gap fillers 30 are coupled to respective siderails 24. According to the preferred embodiment of the present disclosure, second end 22 of frame 12 extends and retracts relative to the remainder of frame 12, thereby expanding or reducing gap 28. According to alternative embodiments of the present disclosure, the gap fillers are used to substantially fill or block other gaps defined in patient support 10 such as gaps defined between the siderails or gaps defined between the headboard and siderails.

Figure 3:
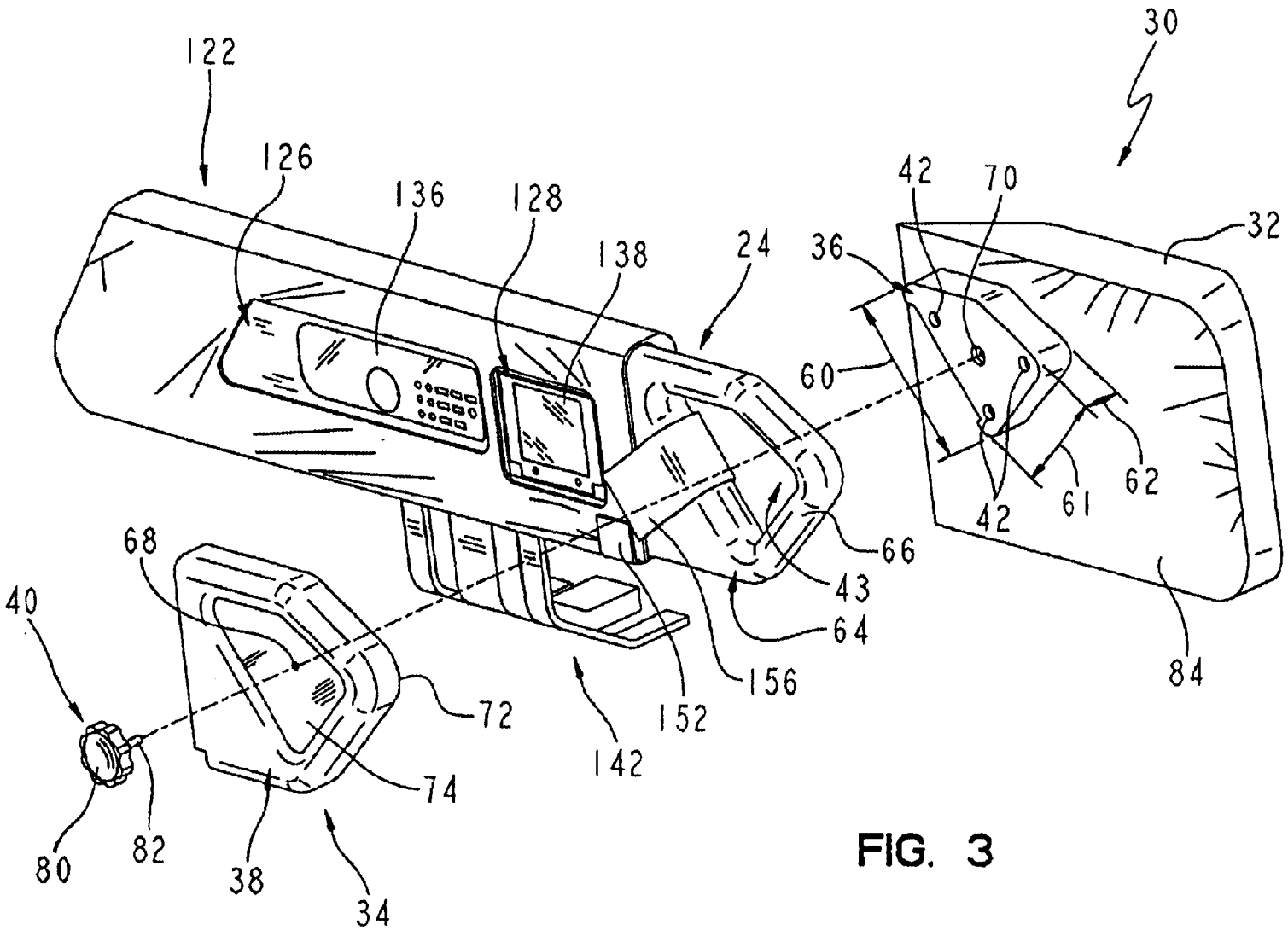
FIG. 3 is a perspective assembly view of one of the siderails, gap fillers, and covers of FIG. 1.

As shown in FIG. 3, each gap filler 30 includes barrier member 32 and a coupler 34 configured to couple barrier member 32 to respective siderails 24. Coupler 34 includes a complementary member 36 rigidly coupled to barrier member 32, a cover or cover plate 38, and a fastener 40 configured to couple cover 38 to barrier member 32. Complementary member 36 is attached to barrier member 32 by fasteners inserted through apertures 42.

Figure 4:
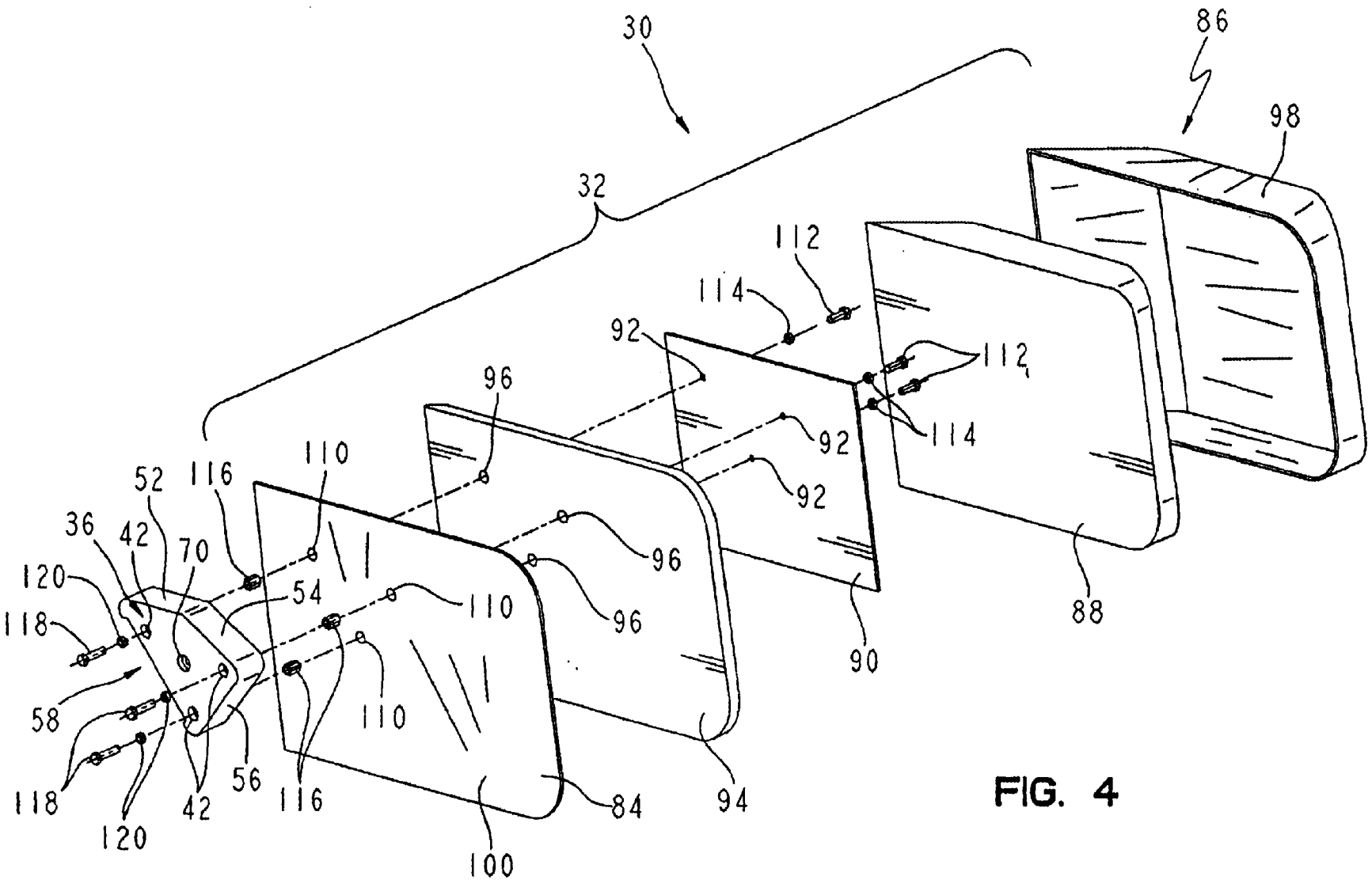
FIG. 4 is a perspective assembly view of the gap filler of FIG. 3.
Figure 5:
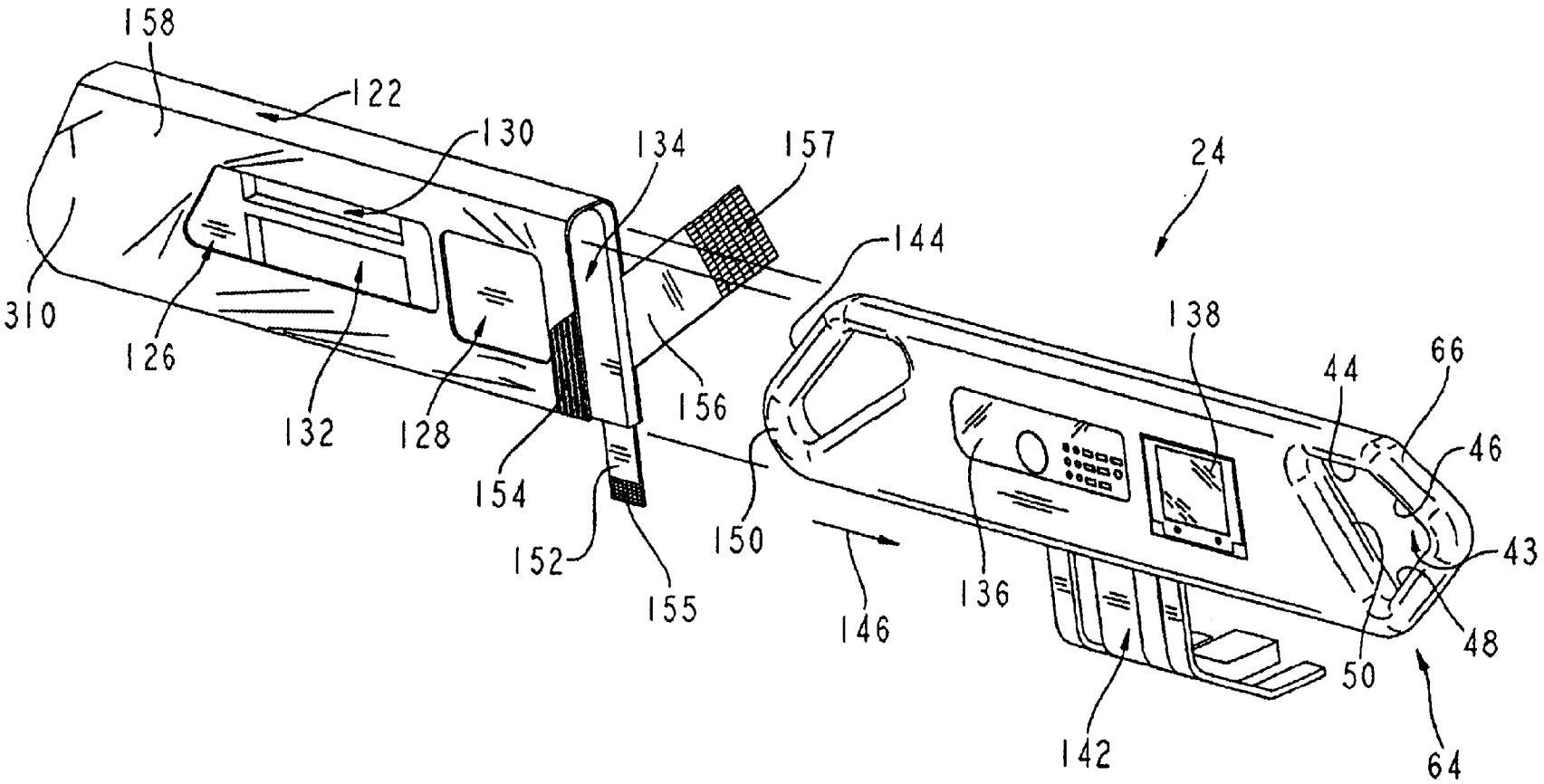
FIG. 5 is a perspective assembly view of the siderail of FIG. 3 and the siderail cover of FIG. 3.

Each complementary member 36 is sized to complement openings 43 through siderails 26. For example, each siderail 26 includes an interior profile that includes four substantially straight edges 44, 46, 48, 50 that define polygon-shaped opening 43 as shown in FIG. 5. Complementary member 36 includes a perimeter profile that includes three substantially straight sidewalls 52, 54, 56 that complement straight edges 44, 46, 48, and a notched sidewall 58 as shown in FIG. 4 that complements straight edge 50. Sidewalls 52, 54 cooperate to define an obtuse angle therebetween that complements an obtuse angle defined by edges 44, 46. Similarly, sidewalls 54, 56 cooperate to define an acute angle therebetween that complements an acute defined by edges 46, 48. Preferably, complementary member 36 has a length 60 of about 7.6 inches, a width 61 of 3.7 inches, and a thickness 62 of about 1.5 inches as shown in FIG. 3.

Gap filler 30 is coupled to siderail 24 by positioning member 36 in opening 43. Next, cover 38 is positioned over a first end 64 of siderail 24 to cover opening 43 and a hand rail portion 66 of siderail 24. Fastener 40 is then inserted through an aperture 68 in cover 38 and threaded into a threaded opening 70 in complementary member 36, thereby rigidly coupling gap filler 30 to siderail 24. Because of the rigid coupling and shape of complementary member 36, barrier member 32 is blocked from rotating relative to siderail 24. Furthermore, when siderail 24 is moved between the raised and lowered positions, gap filler 30 moves will siderail 24 between raised and lowered positions. To remove gap filler 30, fastener 40 is unthreaded from complementary member 36 and cover 40 and barrier member 36 are separated from siderail 24.

Cover plate 38 includes an outer lip 72 and a substantially flat recessed portion 74 that cooperate to define a surface 76 defining a channel 78 as shown in FIG. 2. Channel 78 is sized to receive hand rail portion 66 of siderail 24. As shown in FIG. 3, fastener 38 include a knob 80 and threaded stud 82 rigidly coupled to knob 80. Cover plate 38 and fastener 38 cooperate to provide a clamp with an outer surface 84 of barrier member 36 to define an interior region in which siderail 24 is trapped when fastener 38 is coupled to complementary member 36.

Referring to FIG. 4, barrier member 32 includes an outer ticking or cover 86 and a compliant member or padding 88. Ticking 86 surrounds compliant member 88 and the other internal components of barrier member 32. Ticking 86 may be formed from materials such as plastic, vinyl, leather, or any other suitable covering material. Compliant member 88 may be comprised of foam, plastic, or any other suitable padding material.

A backing plate 90 is provided and positioned adjacent to compliant member 88. Backing plate 90 includes three apertures 92. Plate 90 may be formed from a rigid material such as wood, plastic, metal, fiberglass, or any other suitable rigid material. A rigid support member 94 is provided adjacent to plate 32 and define the profile of a back side of barrier member 32. Support member 94 includes three apertures 96 that align with apertures 92 of backing plate 36 and apertures 42. Support member 94 may be formed from a rigid material such as wood, plastic, metal, fiberglass, or any other suitable rigid material.

Ticking 86 includes an inner cover portion 98 sized to receive compliant member 88, backing plate 90, and support member 94. Ticking 86 also includes an outer cover portion 100 sized to cover support member 94. Inner and outer cover portions 98, 100 are preferably stitched together along their respective perimeter edges. According to alternative embodiments of the present disclosure, the cover portions are ultrasonically welded together, coupled to one another with a zipper, our otherwise coupled together by methods known to those of ordinary skill in the art. Similar to backing plate 90 and rigid support member 94, outer cover portion 100 includes three apertures 110.

As shown in FIG. 4, gap filler 30 is assembled by positioning plate 90, support member 94, and outer cover portion 100 adjacent to one another with apertures 110, 96, 92 aligned with each other to receive fasteners 112. Fasteners 112 are inserted through washers 114 and apertures 92, 96, 110. Next, fastener 112 are threaded into threaded bushings or nuts 116. Complementary member 36 is then positioned adjacent to outer cover portion 100 so that bushings 116 align with openings 42 of complementary member 36. Additional fasteners 118 are inserted through washers 120 and openings 42 and threaded into threaded bushings 116 so that complementary member 36 is rigidly coupled to backing plate 90 with support member 94 and outer cover portion 100 sandwiched in between. Preferably, fasteners 112, 118 are bolts. According to other embodiments, other fasteners such as screws, rivets, snaps, adhesives, or other fasteners known to those of ordinary skill in the art are provided.

Compliant member 88 is preferably coupled to backing plate 90 and support member 94 with an adhesive. According to other another alternative embodiment, no adhesive is provided to couple compliant member 88, but inner cover portion 98 alone supports resilient member adjacent to backing plate 90 and support member 94. According to other alternative embodiments, inner and outer cover portions 98, 100 are coupled to the interior components by adhesive, elastic, staples, or any other suitable method of coupling the inner and outer cover portions 98, 100 to the interior components.

Figure 6:
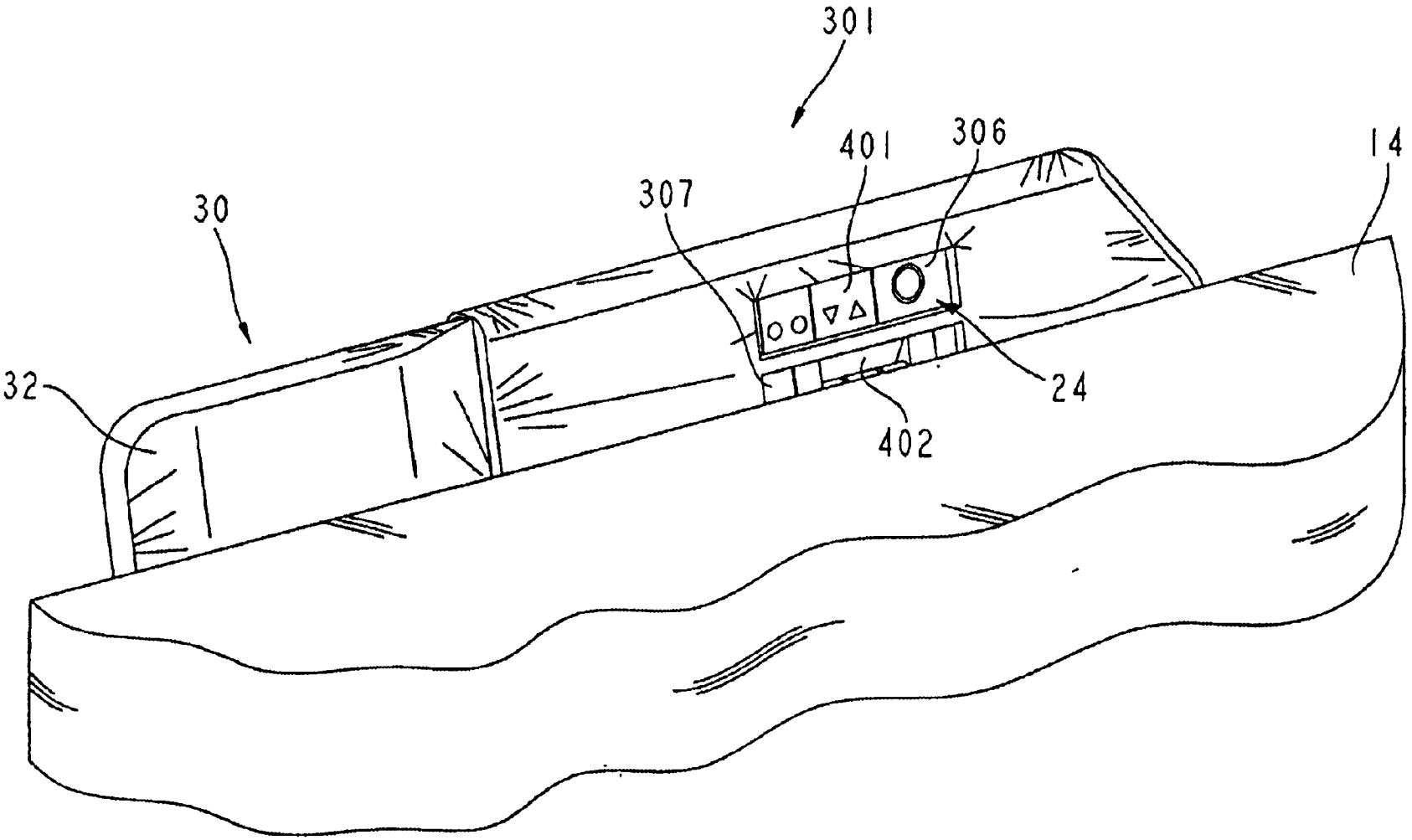
FIG. 6 is a perspective view of a portion of the patient support of FIG. 1 showing a siderail, gap filler, and siderail cover positioned adjacent to the mattress.

As shown in FIGS. 1 and 2, a set of padded siderail covers 122, 124 are provided to cover siderails 24, 26. Siderail cover 122 includes a plurality of openings 126, 128, 130, 132, 134. Opening 126 is positioned to allow access to control panel 136 of siderail 24 when siderail cover 122 is positioned on siderail 24. Opening 128 is positioned to allow access to control panel 138. Control panel 138 is pivotably coupled at is upper end to permit the lower end to be pivoted upward through opening 128 while the upper end remains coupled. Openings 130 is included in siderail cover 122 to allow access to control panel 140 on the opposite side of siderail 24 as shown in FIG. 6.

As shown in FIGS. 1, 2, and 5, each siderail 24, 26 includes a linkage 142 coupled to frame 12 to permit raising and lowering of siderail 24, 26. Opening 132 is sized and positioned to provide clearance for linkage 142 during raising and lowering of siderail 24. Additional description of linkage 142 and other details of patient support 10 are provided in U.S. Pat. No. 5,715,548, to Weismiller et al., the disclosure of which is expressly incorporated by reference herein.

Siderail cover 122 is positioned over siderail 24 by positioning siderail cover 122 adjacent to a second end 144 of siderail 24 so that second end 144 is positioned in opening 134. Next, siderail cover 122 is slide in direction 146 until siderail cover 122 is stopped from further travel in direction 146 by second end 144. When slipped over siderail 24, a lower corner 148 of cover 122 captures a lower corner 150 of second end 144. When installed, cover 122 does not cover in the entire length of siderail 24.

After siderail cover 122 has been slipped over siderail 24 as previously described, a first strap, tab, or flap 152 of cover 122 is positioned under siderail 24. First tab 152 includes hook-and-loop type fasteners 155 that couple to corresponding hook-and-loop type fasteners 154 on the opposite side of cover 122. Similarly, a second strap, tab, or flap 156 of cover 122 is positioned in opening 42 and includes hood-and-loop type fasteners 157 that couple to fasteners 154. This coupling helps secure siderail cover 122 on siderail 122. According to alternative embodiments of the present disclosure, other fasteners are provided such as adhesives, adhesive tape, buttons, snaps, or any other suitable fasteners.

Cover 122 preferably includes an outer ticking 158 made of plastic, vinyl, leather, or any other suitable covering material. Cover 122 further includes a complaint member (not shown) positioned in ticking 158 on the inboard side of siderail 24. The compliant member is preferably made of a foam material or other suitable padding material.

According to the preferred embodiment, ticking 158 defines a pocket that totally encloses the compliant member. A slit (not shown) is provided in ticking 158 near the top of the pocket in the interior of cover 122. During assembly, the compliant member is positioned in the pocket through the slit. Preferably, the complaint member matches the profile of the inboard side of cover 122 that includes opening 130 to provide the inboard sized of siderail 24 with padding. A zipper (not shown) is provided along the slit to permit removal of the compliant member so that ticking 158 can be laundered or the compliant member replaced with a new compliant member (not shown).

As shown in FIG. 6, gap filler 30 may be used on patient support 10 while siderail cover 122 is covering siderail 24. When used together, cover 122 is positioned over siderail 24 before gap filler 30 is coupled to siderail 24. During coupling of gap filler 30 to siderail 24, notched sidewall 58 of complementary member 36 is positioned over second tab 156 of cover 122 to avoid pinching second tab 156 between complementary member 36 and siderail 24.

Siderail cover 124 includes a plurality of openings 160, 162, 164, 166. Opening 160 is positioned to allow access to control panel 168 of siderail 26 when siderail cover 124 is positioned on siderail 26. Opening 162 is positioned over a speaker 170 positioned on an inboard side of siderail 26 to avoid attenuation of the sound generated by speaker 170. Opening 164 is sized and positioned to provide clearance for linkage 142 during raising and lowering of siderail 26.

Siderail cover 124 is positioned over siderail 26 by positioning sliding siderail cover 124 over the top of siderail 26. Opening 166 is partially defined by a slit 172 that permits adjustment of the overall size of opening 166. Slit 172 is provided with a zipper 174. When zipper 174 is unzipped, opening 166 is large enough to permit siderail cover 124 to be slipped over siderail 26. After, cover 124 is positioned over siderail 26, zipper 174 is zipped to reduce the size of opening 166 and block removal of cover 124 from siderail 26.

Cover 124 preferably includes an outer ticking 176 made of plastic, vinyl, leather, or any other suitable covering material. Cover 124 further includes a complaint member (not shown) positioned in ticking 176 on the inboard side of siderail 26. The compliant member is preferably made of a foam material or other suitable padding material.

According to the preferred embodiment, ticking 176 defines a pocket that totally encloses the compliant member. A slit (not shown) is provided in ticking 176 near the top of the pocket in the interior of cover 124. During assembly, the compliant member is positioned in the pocket through the slit. Preferably, the complaint member matches the profile of the inboard side of cover 124 that includes opening 162 to provide the inboard sized of siderail 26 with padding. A zipper (not shown) is provided along the slit to permit removal of the compliant member so that ticking 176 can be laundered or the compliant member replaced with a new compliant member (not shown).

Preferably, instructions for the assembly, installation, and/or use of gap filler 30 and covers 122, 124 are provided with gap filler 30 and covers 122, 124 or otherwise communicated to permit a person or machine to assemble, install and/or use gap filler 30 and covers 122, 124. Such instructions may include a description of any or all portions of gap filler 30 and covers 122, 124 and/or any or all of the above-described assembly, installation, and use of gap filler 30 and covers 122, 124. Furthermore, such instructions may describe the environment in which gap filler 30 and covers 122, 124 are used. The instructions may be provided on separate papers, the packaging in which gap filler 30 and covers 122, 124 are sold or shipped, and/or on gap filler 30 and covers 122, 124. Furthermore, the instructions may be embodied as text, pictures, audio, video, or any other medium or method of communicating instructions known to those of ordinary skill in the art.

The foregoing description of the invention is demonstrative only, and is not intended to limit the scope of the invention to the precise terms set forth. Although the invention has been described in detail with reference to certain illustrative embodiments, variations and modifications exist within the scope and spirit of the invention as described and defined by the following claims.

What is claimed is:

1. A patient support comprising a frame having first and second ends and longitudinal sides extending between the first and second ends, a mattress positioned on the frame, a board coupled to one of the first and second ends of the frame, a first barrier coupled to one of the sides of the frame, the first barrier cooperating with the board to define a gap therebetween, the first barrier defining an opening therethrough, and a second barrier configured to substantially fill the gap, the second barrier including a barrier member and a coupler configured to rigidly couple the barrier member to the first barrier, the barrier member including a surface sized to substantially cover a first side of the opening, the coupler including a surface sized to substantially cover a second side of the opening in the first barrier and a fastener coupling the surface of the barrier member to the surface of the fastener.

2. The patient support of claim 1, wherein the opening of the first barrier is shaped as a polygon and the coupler further includes a rotation-blocking member rigidly coupled to the barrier member having a polygonal perimeter sized to complement the opening of the first barrier.

3. The patient support of claim 2, wherein the polygonal perimeter included a pair of substantially straight sidewalls cooperating to define an acute angle.

4. The patient support of claim 1, wherein the barrier member is padded.

5. The patient support of claim 1, wherein the first barrier includes first and second longitudinally spaced-apart ends, the surface of the coupler includes a channel sized to receive a portion of the first end of the first barrier.

6. The patient support of claim 1, further comprising a padded cover sized to receive the first barrier.

7. The patient support of claim 6, wherein the padded cover includes a tab configured to extend through the opening in the first barrier.

8. A supplemental barrier for use with a patient support having a first barrier positioned to block egress of a patient from the patient support, the first barrier cooperating to define a gap adjacent thereto, the supplemental barrier comprising a barrier member sized to substantially block the gap adjacent to the first barrier, and a clamp including substantially rigid first and second portions, the first portion being movable relative to the second portion to couple the barrier member to the first barrier.

9. The supplemental barrier of claim 8, wherein the clamp includes a cover sized to fit over a portion of the first barrier and a fastener configured to couple the cover to the barrier member.

10. The supplemental barrier of claim 9, wherein the fastener includes a threaded stud and a knob, and the cover is positioned between the knob and the barrier member.

11. The supplemental barrier of claim 9, wherein the cover includes an aperture sized to receive the fastener.

12. The supplemental barrier of claim 8, wherein the clamp defines an interior region sized to receive a portion of the first barrier.

13. The supplemental barrier of claim 8, wherein the clamp is configured to block rotation of the barrier member relative to the first barrier.

14. A barrier configured to couple to a patient support including a siderail defining an opening therethrough and an end board, the siderail and end board cooperating to define a gap, the barrier comprising a barrier member sized to substantially fill the gap, and a coupler including a fastener and a complementary member configured to complement the opening in the bed siderail, the fastener being configured to rigidly couple the barrier member to the siderail.

15. The barrier of claim 14, wherein complementary member includes a perimeter surface that is polygonal.

16. The barrier of claim 15, wherein the perimeter surface has first, second, and third side walls, the first and second side walls cooperate to define an obtuse angle, and the second and third side walls cooperate to define an acute angle.

17. The barrier of claim 14, wherein the complementary member has a width greater than 3 inches.

18. The barrier of claim 14, wherein the complementary member includes a notched portion.

19. A barrier configured to couple to a bed including a siderail and an end board, the siderail and end board cooperating to define a gap, the barrier comprising:

a padded barrier member sized to substantially block the gap defined between the siderail and the endboard, and a coupler configured to removably couple the padded barrier member to the siderail, the padded barrier includes a complementary member sized to complement an opening in the siderail.

20. A method for coupling a barrier to a patient support siderail including an opening therethrough, the method comprising the steps of providing a barrier including a coupler and a barrier member sized to substantially fill a gap adjacent to the siderail, the coupler including a fastener and a complementary member, the complementary member being rigidly coupled to the barrier member and configured to complement the opening in the siderail, the fastener being configured to rigidly couple the barrier member to the siderail, positioning the complementary member in the siderail opening, and coupling the complementary member to the siderail with the fastener.

21. The method of claim 20, wherein the coupler further includes a cover plate sized to cover the opening during the coupling step, further comprising the step of positioning the cover plate over the opening to position the siderail between the barrier member and the cover plate.

22. The method of claim 20, wherein the opening in the siderail is defined by a plurality of substantially straight edges and the complementary member includes a plurality of substantially straight sidewalls, during the positioning step, the plurality of substantially straight sidewalls are aligned with the corresponding substantially straight edges that define the opening in the siderail.

23. The method of claim 20, wherein the providing step further includes providing a padded siderail cover, further comprising that step of positioning the padded siderail cover over the siderail before positioning the complementary member in the siderail opening.

24. The method of claim 23, wherein the padded siderail cover includes a tab that is positioned in the opening of the siderail during the positioning step.

* * * * *